US010204558B2

(12) United States Patent
Chen et al.

(10) Patent No.: US 10,204,558 B2
(45) Date of Patent: Feb. 12, 2019

(54) PIXEL CIRCUIT, DRIVING METHOD THEREOF, AND DISPLAY APPARATUS

(71) Applicants: BOE TECHNOLOGY GROUP CO., LTD., Beijing (CN); ORDOS YUANSHENG OPTOELECTRONICS CO., LTD., Ordos, Inner Mongolia (CN)

(72) Inventors: Yipeng Chen, Beijing (CN); Minghua Xuan, Beijing (CN)

(73) Assignees: BOE TECHNOLOGY GROUP CO., LTD., Beijing (CN); ORDOS YUANSHENG OPTOELECTRONICS CO., LTD., Ordos, Inner Mongolia (CN)

( * ) Notice: Subject to any disclaimer, the term of this patent is extended or adjusted under 35 U.S.C. 154(b) by 14 days.

(21) Appl. No.: 15/314,000

(22) PCT Filed: Mar. 21, 2016

(86) PCT No.: PCT/CN2016/076855
§ 371 (c)(1),
(2) Date: Nov. 25, 2016

(87) PCT Pub. No.: WO2016/165529
PCT Pub. Date: Oct. 20, 2016

(65) Prior Publication Data

US 2017/0193910 A1 Jul. 6, 2017

(30) Foreign Application Priority Data

Apr. 16, 2015 (CN) ..... 2015 1 0181402

(51) Int. Cl.
*G09G 3/30* (2006.01)
*G09G 3/32* (2016.01)
(Continued)

(52) U.S. Cl.
CPC ..... *G09G 3/3258* (2013.01); *G09G 3/325* (2013.01); *G09G 3/3233* (2013.01);
(Continued)

(58) Field of Classification Search
CPC ..... G09G 3/3233
See application file for complete search history.

(56) References Cited

U.S. PATENT DOCUMENTS

2003/0122745 A1 7/2003 Miyazawa
2005/0067970 A1 3/2005 Libsch et al.
(Continued)

FOREIGN PATENT DOCUMENTS

CN 1901016 A 1/2007
CN 102982764 A 3/2013
(Continued)

OTHER PUBLICATIONS

Second Chinese Office Action dated Mar. 27, 2017; Appln. No. 201510181402.0.
(Continued)

*Primary Examiner* — Nan-Ying Yang
(74) *Attorney, Agent, or Firm* — Ladas & Parry LLP

(57) ABSTRACT

Provided are a pixel circuit, a driving method thereof and a display apparatus. The pixel circuit includes a first switching module (10), a first driving module (20), a second switching module (30), a second driving module (40), a coupling module (50) and a light-emitting module (60). The first switching module (10) is connected with a first scan signal terminal (Vscan1), a data signal terminal (Vdata), the first driving module (20) and the coupling module (50) respectively; the second switching module (30) is connected with a second scan signal terminal (Vscan2), the data signal terminal (Vdata), the second driving module (40) and the coupling module (50) respectively; the coupling module
(Continued)

(50) is further connected with a first voltage terminal (Vdd), the first driving module (20) and the second driving module (40); the first driving module (20) is further connected with the first voltage terminal (Vdd) and the light-emitting module (60); the second driving module (40) is further connected with the first voltage terminal (Vdd) and the light-emitting module (60); the light-emitting module (60) is further connected with a enable signal terminal (Em) and a second voltage terminal (Vss). It can compensate for a shifting of threshold voltage of a TFT, improve uniformity of display brightness of the display apparatus and prolong a lifespan of the display apparatus.

20 Claims, 5 Drawing Sheets

(51) Int. Cl.

| | |
|---|---|
| ***G09G 3/3225*** | (2016.01) |
| ***G09G 3/3258*** | (2016.01) |
| ***G09G 3/325*** | (2016.01) |
| ***G09G 3/3266*** | (2016.01) |
| ***G09G 3/3291*** | (2016.01) |
| ***G09G 3/3233*** | (2016.01) |

(52) U.S. Cl.
CPC ..... *G09G 3/3266* (2013.01); *G09G 3/3291* (2013.01); *G09G 2300/043* (2013.01); *G09G 2300/0809* (2013.01); *G09G 2300/0852* (2013.01); *G09G 2300/0861* (2013.01); *G09G 2310/0262* (2013.01); *G09G 2320/045* (2013.01); *G09G 2320/0646* (2013.01)

(56) References Cited

U.S. PATENT DOCUMENTS

| | | | | |
|---|---|---|---|---|
| 2013/0063040 | A1 | 3/2013 | Huang et al. | |
| 2013/0093736 | A1 * | 4/2013 | Katsuse ..... | G09G 3/3233 345/204 |
| 2014/0320550 | A1 | 10/2014 | Liao et al. | |

FOREIGN PATENT DOCUMENTS

| | | | | | |
|---|---|---|---|---|---|
| CN | 103000127 | A | | 3/2013 | |
| CN | 103310730 | A | | 9/2013 | |
| CN | 104021763 | A | * | 9/2014 | ..... G09G 3/32 |
| CN | 104123908 | A | | 10/2014 | |
| CN | 203870952 | U | | 10/2014 | |
| CN | 104732929 | A | | 6/2015 | |

OTHER PUBLICATIONS

International Search Report and Written Opinion dated Jun. 22, 2016; PCT/CN2016/076855.
First Chinese Office Action dated Aug. 2, 2016; Appln. No. 201510181402.0.

* cited by examiner

PIXEL CIRCUIT, DRIVING METHOD THEREOF, AND DISPLAY APPARATUS

TECHNICAL FIELD

The present disclosure relates to a pixel circuit, a driving method thereof, and a display apparatus.

BACKGROUND

With the rapid development of display technology, the technology for semiconductor elements which is a core of the display apparatus has also progressed rapidly. For the existing display apparatus, an Organic Light Emitting Diode (referred to as OLED), as a current type light emitting device, has been widely used in the field of high performance display field more and more because of its characteristics of self emission, fast response, wide viewing angle and capability of being fabricated on a flexible substrate, etc.

The OLED can be divided into two types according to driving manners, that is, a Passive Matrix Driving OLED (referred to as PMOLED) and an Active Matrix Driving OLED (referred to as AMOLED). Because the AMOLED display has advantages such as low manufacturing cost, high response speed, energy saving, being applicable in DC drive for portable devices, wide working temperature range and the like, it has a prospect of replacing liquid crystal display (referred to as LCD) to become a next generation new-type flat panel display. In the existing AMOLED display panel, each OLED comprises a plurality of Thin Film Transistor (referred to as TFT) switch circuits. Among them, amorphous silicon TFT has been widely used in the field of liquid crystal display, a matrix image sensor, etc., as a kind of important electronic devices, because of its excellent static electricity characteristics.

However, instability of the amorphous silicon TFT is always a problem to be solved in the known technical scheme. One of the main instability of the amorphous silicon TFT is in that a threshold voltage of the TFT would shift in a condition of a DC gate bias applied for a long time. For example, in a high voltage area (greater than 25V generally), the shift of the threshold voltage is due to a shielding for a gate electric field after traps in an insulating layer trap charges; in a low voltage area (generally an operation voltage of the amorphous silicon TFT), the shift of the threshold voltage is due to a generating or removing of a dangling bond states caused by the bias voltage in an active layer. The shift of the threshold voltage will cause a decrease of a luminance of the AMOLED display, which will affect uniformity of brightness in the display. In addition, the TFTs in the AMOLED would be in the bias state for a long time during the operation status, which would speed up a decay rate of the TFTs and reduce a lifespan of the display apparatus.

SUMMARY

At least one embodiment of the present disclosure provides a pixel circuit capable of compensating for a shift of a threshold voltage of a TFT, a driving method thereof, and a display apparatus, which can improve uniformity in brightness of the display apparatus and prolong a lifespan of the display apparatus.

According to an aspect of the present disclosure, there is provided a pixel circuit comprising a first switching module, a first driving module, a second switching module, a second driving module, a coupling module and a light-emitting module.

The first switching module is connected with a first scan signal terminal, a data signal terminal, the first driving module and the coupling module respectively, and is configured to be turned on or off under the control of the first scan signal terminal, wherein the first switching module outputs a signal of the data signal terminal to the coupling module and the first driving module in the ON state so as to turn on the first driving module.

The second switching module is connected with a second scan signal terminal, the data signal terminal, the second driving module and the coupling module respectively, and is configured to be turned on or off under the control of the second scan signal terminal, wherein the second switching module outputs the signal of the data signal terminal to the coupling module and the second driving module in the ON state so as to turn on the second driving module.

The coupling module is further connected with a first voltage terminal, the first driving module and the second driving module, and is configured to output a signal of the first voltage terminal to the second driving module so as to turn off the second driving module when the first switching module inputs the signal of the data signal terminal; alternatively, is configured to output the signal of the first voltage terminal to the first driving module so as to turn off the first driving module when the second switching module inputs the signal of the data signal terminal.

The first driving module is further connected with the first voltage terminal and the light-emitting module, and is configured to drive the light-emitting module to emit light under the control of the first voltage terminal in the ON state.

The second driving module is further connected with the first voltage terminal and the light-emitting module, and is configured to drive the light-emitting module to emit light under the control of the first voltage terminal in the ON state.

The light-emitting module is further connected with an enable signal terminal and a second voltage terminal, and is configured to emit light as driven by the first driving module or the second driving module under the control of the enable signal terminal and the second voltage terminal.

According to another aspect of the present disclosure, there is provided a display apparatus comprising any one of the pixel circuit described above.

According to a still further aspect of the present disclosure, there is provided a driving method of a pixel circuit, for driving any one of the pixel circuit described above, comprising:

in a first phase of the Nth frame, the first switching module being turned on to output the signal of the data signal terminal to the coupling module and the first driving module; the first driving module being turned on, the signal input from the first voltage terminal charging the first driving module; and the coupling module outputting the signal input from the first voltage terminal to the second driving module, the second driving module being turned off;

in a second phase of the Nth frame, the first driving module remaining to be in the ON state, the second driving module remaining to be in the OFF state, the light-emitting module being in the ON state, and the first driving module driving the light-emitting module to emit light under the control of the first voltage terminal;

in a first phase of the (N+1)th frame, the second switching module being turned on to output the signal of the data signal terminal to the coupling module and the second driving module; the second driving module being turned on, the signal input from the first voltage terminal charging the second driving module; and the coupling module outputting the signal input from the first voltage terminal to the first driving module, the first driving module being turned off;

in a second phase of the (N+1)th frame, the second driving module remaining to be in the ON state, the first driving module remaining to be in the OFF state, the light-emitting module being in the ON state, and the second driving module driving the light-emitting module to emit light under the control of the first voltage terminal;

wherein N is a positive integer greater than or equal to 1.

At least one embodiment of the present disclosure provides a pixel circuit, a driving method thereof, and a display apparatus, wherein the pixel circuit comprises a first switching module, a first driving module, a second switching module, a second driving module, a coupling module and a light-emitting module. The first switching module is connected with a first scan signal terminal, a data signal terminal, the first driving module and the coupling module respectively, and is configured to be turned on or off under the control of the first scan signal terminal, wherein the first switching module outputs a signal of the data signal terminal to the coupling module and the first driving module in the ON state so as to turn on the first driving module. The second switching module is connected with a second scan signal terminal, the data signal terminal, the second driving module and the coupling module respectively, and is configured to be turned on or off under the control of the second scan signal terminal, wherein the second switching module outputs the signal of the data signal terminal to the coupling module and the second driving module in the ON state so as to turn on the second driving module. The coupling module is further connected with a first voltage terminal, the first driving module and the second driving module, and is configured to output a signal of the first voltage terminal to the second driving module so as to turn off the second driving module when the first switching module inputs the signal of the data signal terminal; alternatively, is configured to output the signal of the first voltage terminal to the first driving module so as to turn off the first driving module when the second switching module inputs the signal of the data signal terminal. The first driving module is further connected with the first voltage terminal and the light-emitting module, and is configured to drive the light-emitting module to emit light under the control of the first voltage terminal in the ON state. The second driving module is further connected with the first voltage terminal and the light-emitting module, and is configured to drive the light-emitting module to emit light under the control of the first voltage terminal in the ON state. The light-emitting module is further connected with an enable signal terminal and a second voltage terminal, and is configured to emit light as driven by the first driving module or the second driving module under the control of the enable signal terminal and the second voltage terminal.

As such, in the Nth frame, the first driving module is turned on, the coupling module may control the second driving module to be in the OFF state, therefore the first driving module may control the light-emitting module to emit light and the threshold voltages of the TFTs in the second driving module may be restored as the second driving module is in the OFF state. In the (N+1)th frame, the second driving module is turned on, the coupling module may control the first driving module to be in the OFF state, therefore the second driving module may control the light-emitting module to emit light and the threshold voltages of the TFTs in the first driving module may be restored as the first driving module is in the OFF state.

In a word, the driving circuit described above drives the light-emitting module to emit light with the first driving module and the second driving module in turn, therefore it can avoid the shifting of the threshold voltage because of a long-time bias voltage state of the gate of the driving TFT in the driving module, which in turn can improve the uniformity of brightness of the display apparatus.

DETAILED DESCRIPTION

Thereafter, solutions of embodiments of the present disclosure will be described clearly and completely in connection with drawings of the embodiments of the present disclosure, but obviously the described embodiments are only some, but not all of the embodiments of the present disclosure. Any other embodiments obtained by those ordinary skilled in the art based on the embodiments of the present disclosure without inventive labors should fall into a scope sought for protection in the present disclosure.

Figure 1:
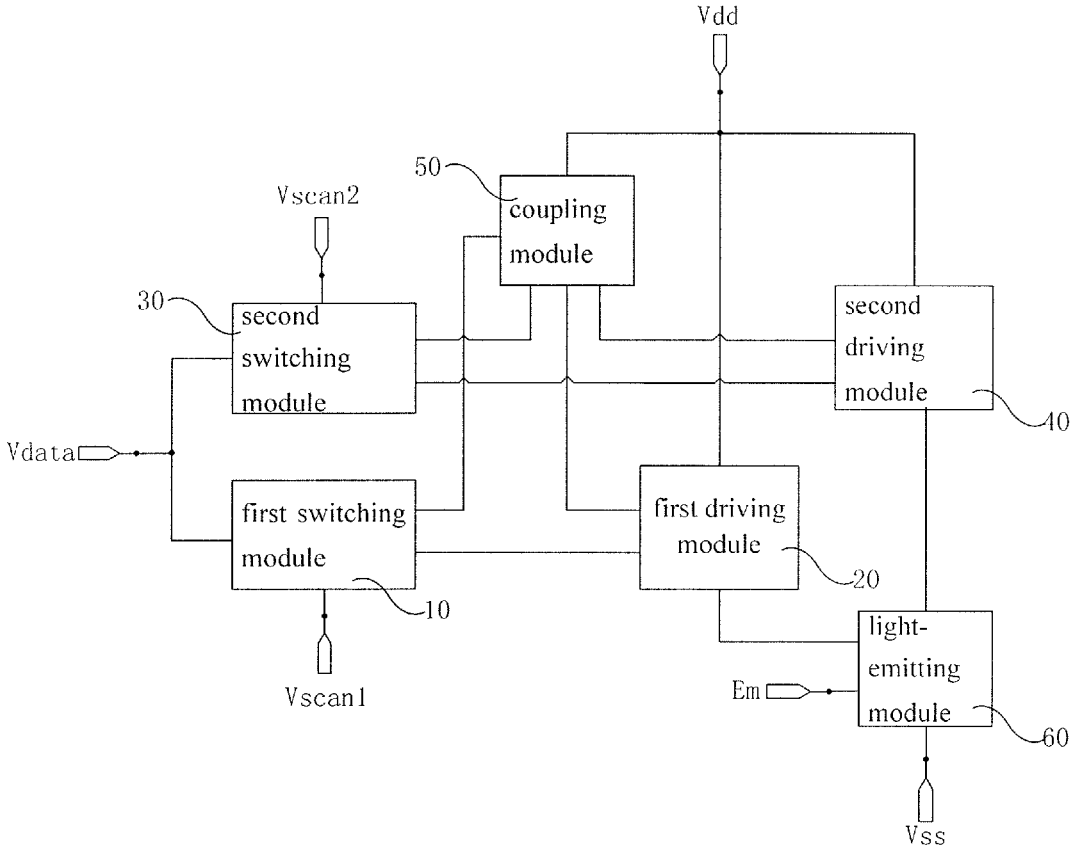
FIG. 1 is an exemplary view illustrating a structure of a pixel circuit according to an embodiment of the present disclosure.

FIG. 1 is an exemplary view illustrating a structure of a pixel circuit according to the embodiment of the present disclosure. As illustrated in FIG. 1, the pixel circuit may comprise a first switching module 10, a first driving module 20, a second switching module 30, a second driving module 40, a coupling module 50 and a light-emitting module 60.

For example, the first switching module 10 may be connected with a first scan signal terminal Vscan1, a data signal terminal Vdata, the first driving module 20 and the coupling module 50 respectively.

The first switching module 10 is configured to be turned on or off under the control of the first scan signal terminal Vscan1, wherein the first switching module 10 outputs a signal of the data signal terminal Vdata to the coupling module 50 and the first driving module 20 in the ON state so as to turn on the first driving module 20.

The second switching module 30 is connected with a second scan signal terminal Vscan2, the data signal terminal Vdata, the second driving module 40 and the coupling module 50 respectively.

The second switching module 30 is configured to be turned on or off under the control of the second scan signal terminal Vscan2, wherein the second switching module 30 outputs the signal of the data signal terminal Vdata to the coupling module 50 and the second driving module 40 in the ON state so as to turn on the second driving module 40.

The coupling module 50 is further connected with a first voltage terminal Vdd, the first driving module 20 and the second driving module 40. The coupling module 50 is configured to control the second driving module 40 to be in an OFF state by means of the first voltage terminal Vdd in a state where the first driving module 20 is turned on; alternatively, is configured to control the first driving module 20 to be in the OFF state by means of the first voltage terminal Vdd in a state where the second driving module 40 is turned on.

The coupling module 50 is configured to output the signal of the first voltage terminal Vdd to the second driving module 40 so as to turn off the second driving module 40 when the first switching module 10 inputs the signal of the data signal terminal Vdata; and is further configured to output the signal of the first voltage terminal Vdd to the first driving module 20 so as to turn off the first driving module 20 when the second switching module 30 inputs the signal of the data signal terminal Vdata.

The first driving module 20 is further connected with the first voltage terminal Vdd and the light-emitting module 60, and is configured to drive the light-emitting module 60 to emit light under the control of the first voltage terminal Vdd in the ON state.

The second driving module 40 is further connected with the first voltage terminal Vdd and the light-emitting module 60, and is configured to drive the light-emitting module 60 to emit light under the control of the first voltage terminal Vdd in the ON state.

The light-emitting module 60 is further connected with an enable signal terminal EM and a second voltage terminal Vss, and is configured to emit light as driven by the first driving module 20 or the second driving module 40 under the control of the enable signal terminal EM and the second voltage terminal Vss.

The embodiment of the present disclosure provides a pixel circuit, the pixel circuit comprises a first switching module, a first driving module, a second switching module, a second driving module, a coupling module and a light-emitting module. The first switching module is connected with a first scan signal terminal, a data signal terminal, the first driving module and the coupling module respectively, and is configured to be turned on or off under the control of the first scan signal terminal, wherein the first switching module outputs a signal of the data signal terminal to the coupling module and the first driving module in the ON state so as to turn on the first driving module. The second switching module is connected with a second scan signal terminal, the data signal terminal, the second driving module and the coupling module respectively, and is configured to be turned on or off under the control of the second scan signal terminal, wherein the second switching module outputs the signal of the data signal terminal to the coupling module and the second driving module in the ON state so as to turn on the second driving module. The coupling module is further connected with a first voltage terminal, the first driving module and the second driving module, and is configured to output a signal of the first voltage terminal to the second driving module so as to turn off the second driving module when the first switching module inputs the signal of the data signal terminal; alternatively, is configured to output the signal of the first voltage terminal to the first driving module so as to turn off the first driving module when the second switching module inputs the signal of the data signal terminal. The first driving module is further connected with the first voltage terminal and the light-emitting module, and is configured to drive the light-emitting module to emit light under the control of the first voltage terminal in the ON state. The second driving module is further connected with the first voltage terminal and the light-emitting module, and is configured to drive the light-emitting module to emit light under the control of the first voltage terminal in the ON state. The light-emitting module is further connected with an enable signal terminal and a second voltage terminal, and is configured to emit light as driven by the first driving module or the second driving module under the control of the enable signal terminal and the second voltage terminal.

As such, in the Nth frame, the first driving module is turned on, the coupling module may control the second driving module to be in the OFF state, therefore the first driving module may control the light-emitting module to emit light and the threshold voltages of the TFTs in the second driving module may be restored as the second driving module is in the OFF state. In the (N+1)th frame, the second driving module is turned on, the coupling module may control the first driving module to be in the OFF state, therefore the second driving module may control the light-emitting module to emit light and the threshold voltages of the TFTs in the first driving module may be restored as the first driving module is in the OFF state.

In a word, the driving circuit described above drives the light-emitting module to emit light with the first driving module and the second driving module in turn, therefore it can avoid the shifting of the threshold voltage because of a long-time bias voltage state of the gate of the driving TFT in the driving module, which in turn can improve the uniformity of brightness of the display apparatus.

It should be noted that the present disclosure is described by taking an case where the first voltage terminal Vdd inputs a high voltage level and the second voltage terminal Vss inputs a low voltage level or is grounded as an example, and the terms "high" and "low" used herein only denote a relative amplitude relationship between input voltages.

Thereafter, structures of the respective modules in the pixel circuit will be explained in details by means of embodiments.

Embodiment 1

Figure 2:
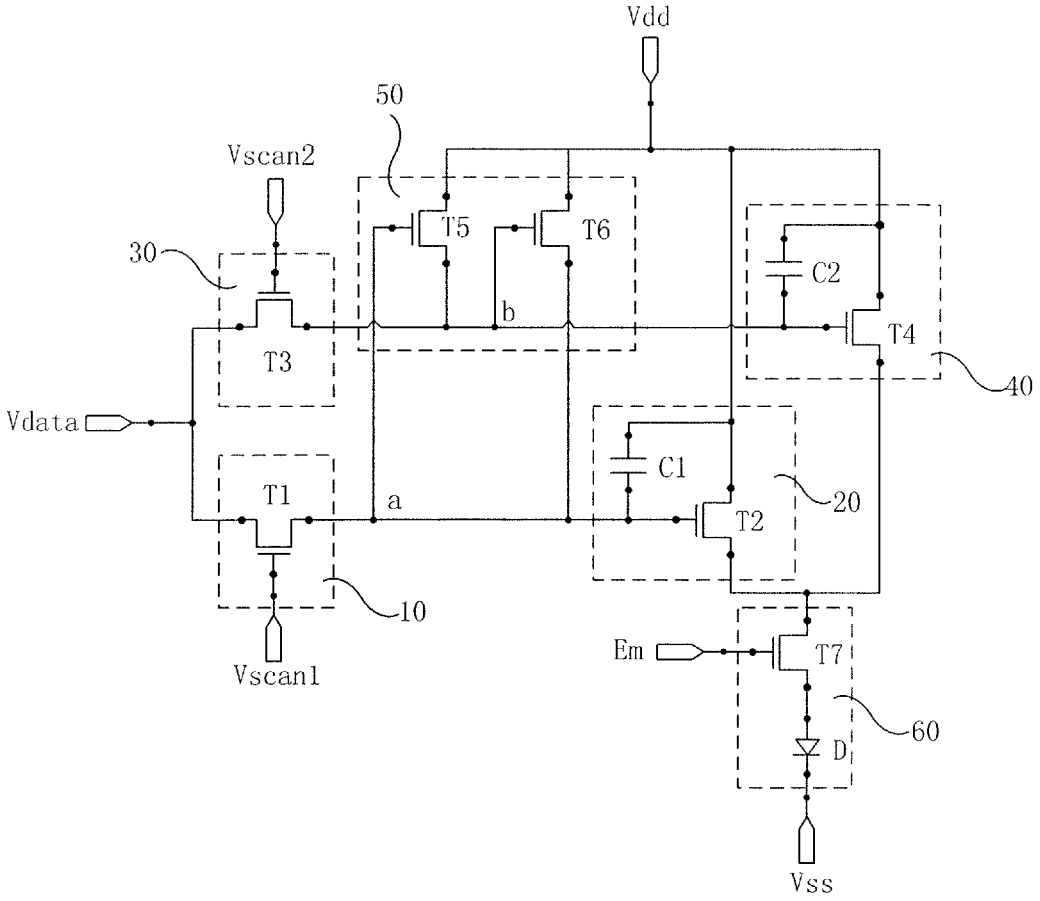
FIG. 2 is an exemplary view illustrating structures of the modules in the pixel circuit shown in FIG. 1.

As illustrated in FIG. 2, an embodiment of the present disclosure provides a pixel circuit and the pixel circuit may comprise a first switching module 10, a first driving module 20, a second switching module 30, a second driving module 40, a coupling module 50 and a light-emitting module 60.

The first switching module 10 may comprise a first transistor T1, a gate thereof is connected with a first scan signal terminal Vscan1, a first electrode thereof is connected with a data signal terminal Vdata and a second electrode is connected with the first driving module 20.

The first driving module 20 may comprise a second transistor T2 and a first capacitor C1.

A gate of the second transistor T2 is connected with the first switching module 10, a first electrode thereof is connected with a first voltage terminal Vdd, a second electrode is connected with the light-emitting module 60. If the first switching module 10 is configured with the above structure, the gate of the second transistor T2 is connected with the second electrode of the first transistor T1.

One terminal of the first capacitor C1 is connected with the gate of the second transistor T2, and the other terminal is connected with the first electrode of the second transistor T2.

The second switching module 30 may comprise a third transistor 13, a gate thereof is connected with a second scan signal terminal Vscan2, a first electrode thereof is connected with the data signal terminal Vdata and a second electrode thereof is connected with the second driving module 40.

The second driving module 40 may comprise a fourth transistor T4 and a second capacitor C2.

A gate of the fourth transistor T4 is connected with the second switching module 30, a first electrode thereof is connected with the first voltage terminal Vdd and a second electrode thereof is connected with the light-emitting module 60. If the second switching module 30 is configured with the above structure, the gate of the fourth transistor T4 is connected with the second electrode of the third transistor T3.

One terminal of the second capacitor C2 is connected with the gate of the fourth transistor T4, and the other terminal is connected with the first electrode of the fourth transistor T4.

The coupling module 50 may comprise a fifth transistor T5 and a sixth transistor T6.

A gate of the fifth transistor T5 is connected with the first switching module 10, a first electrode thereof is connected with the first voltage terminal Vdd and a second electrode thereof is connected with the gate of the fourth transistor T4. If the first switching module 10 is configured with the above structure, the gate of the fifth transistor T5 is connected with the second electrode of the first transistor T1.

A gate of the sixth transistor T6 is connected with the second switching module 30, a first electrode thereof is connected with the first voltage terminal Vdd, a second electrode thereof is connected with the gate of the second transistor T2. If the second switching module 30 is configured with the above structure, the gate of the sixth transistor T6 is connected with the second electrode of the third transistor T3.

The light-emitting module 60 may comprise a seventh transistor T7 and a light-emitting element D.

A gate of the seventh transistor T7 is connected with an enable signal terminal Em, a first electrode thereof is connected with the first driving module 20 and the second driving module 40, and a second electrode thereof is connected with an anode of the light-emitting element D. if the first driving module 20 is configured with the above structure, the first electrode of the seventh transistor T7 is connected with the second electrode of the second transistor T2. If the second driving module 40 is configured with the above structure, the first electrode of the seventh transistor T7 is connected with the second electrode of the fourth transistor T4.

A cathode of the light-emitting element D is connected with a second voltage terminal Vss.

It should be noted that, firstly, the light-emitting element D in the embodiments of the present disclosure may be various current-driven light emitting elements in the prior art, including a Light Emitting Diode (referred to as LED) or an Organic Light Emitting Diode (referred to as OLED). The embodiments of the present disclosure will be explained by taking the OLED as an example.

Secondly, the transistors may be divided into P channel transistors (referred to as P type transistors) and N channel transistors (referred to as N type transistors) depending on different types of the channels. The present disclosure is not limited thereto.

The first electrode of the above transistor may be a drain and the second electrode may be a source; alternatively, the first electrode may be the source and the second electrode may be the drain, and the present disclosure is not limited thereto.

Furthermore, the transistors in the above pixel circuit may be divided into enhancement transistors and depletion transistors depending on different conduction manners of the transistors, but the present disclosure is not limited thereto.

Figure 3:
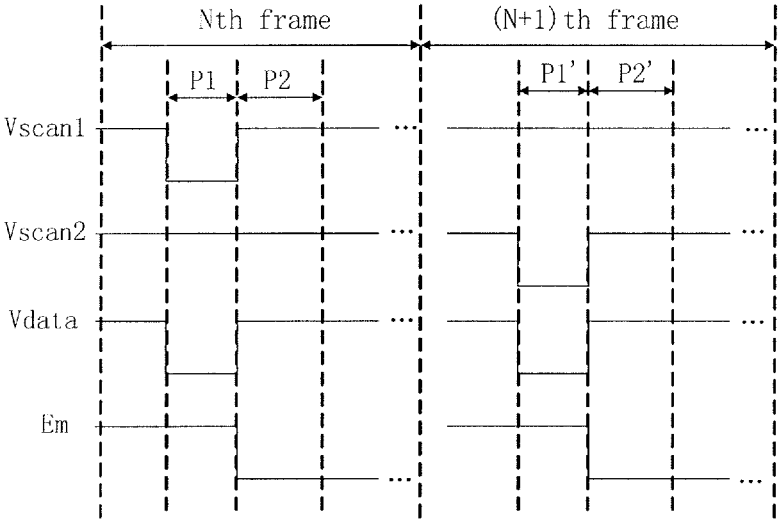
FIG. 3 is a timing diagram of control signals in the pixel circuit shown in FIG. 2.

Thereafter an operation process of the pixel circuit according to the embodiment of the present disclosure will be explained in detailed in connection with a timing diagram (as illustrated in FIG. 3). Wherein the present embodiment will be described by taking a case where all of the transistors are P type transistors as an example.

As illustrated in FIG. 3, a display process for each frame of the pixel circuit may be divided into a writing phase P1 and a light emitting phase P2.

Figure 4A:
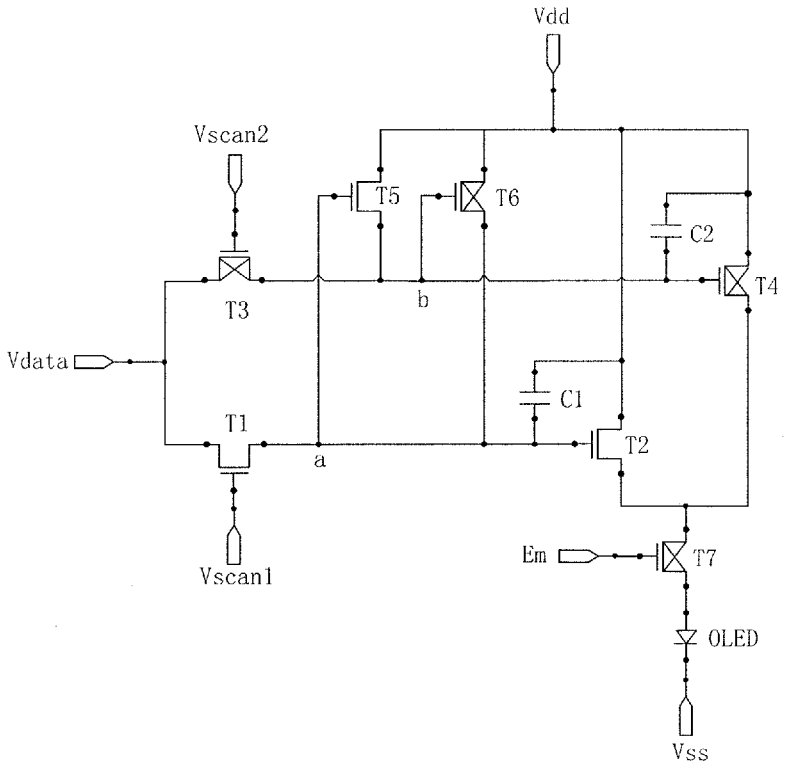
FIG. 4*a* is an exemplary view illustrating ON or OFF state of the pixel circuit shown in FIG. 2, in a writing phase P1 of the Nth frame in FIG. 3.

In the writing phase P1 for the Nth frame, an equivalent circuit diagram for this phase is illustrated in FIG. 4*a*, wherein a sign "x" is denoted on the transistor in an OFF state in the drawings.

In this phase, the first scan signal terminal Vscan1 inputs the low voltage level, the first transistor T1 is turned on, so that a data signal (low voltage level) input from the data signal terminal Vdata is transferred to the gate (at a node a) of the second transistor 12 through the first transistor T1 and charges the first capacitor C1.

The fifth transistor T5 is in the ON state because a potential at the node a is the low voltage level, so that the high voltage level input from the first voltage terminal Vdd is transferred to the gate of the fourth transistor T4 and the fourth transistor T4 is turned off, thus it prevents the fourth transistor T4 from being turned on in this phase.

Further, the third transistor T3 and the seventh transistor T7 are both in the OFF state because the second scan signal terminal Vscan2 and the enable signal terminal Em input the high voltage level, so the sixth transistor T6 is in the OFF state in this case.

Therefore, the OLED emits no light in this phase.

Figure 4B:
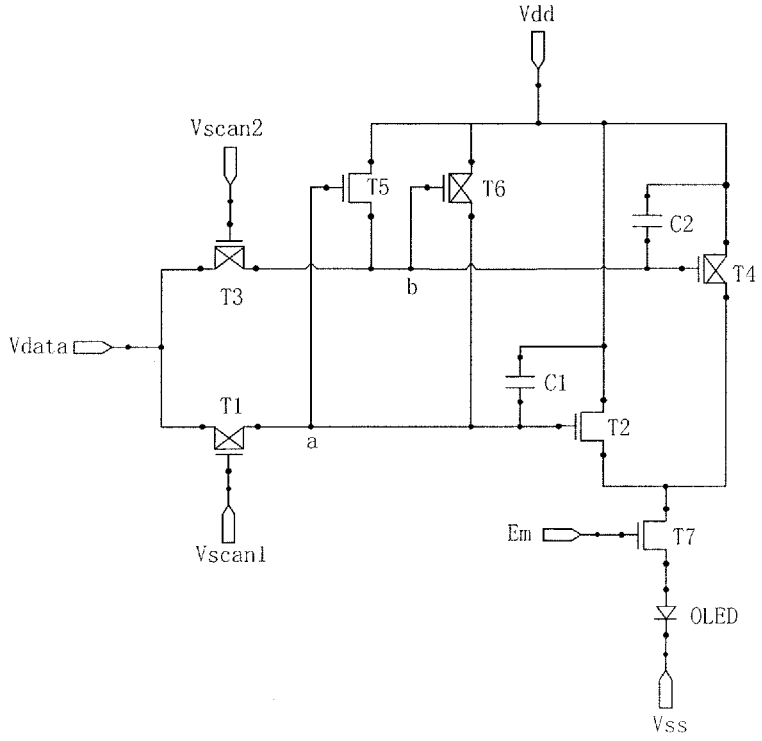
FIG. 4*b* is an exemplary view illustrating ON or OFF state of the pixel circuit shown in FIG. 2, in a light-emitting phase P2 of the Nth frame in FIG. 3.

In the light emitting phase P2 for the Nth frame, the equivalent circuit diagram for this phase is illustrated in FIG. 4*b*. The first scan signal terminal Vscan1 inputs the high voltage level, the first transistor T1 is in the OFF state. The first capacitor C1 has a charge retention function, so the node a remains to be in the low voltage level. In this case, the fifth transistor T5 is still turned on, so that the high voltage level input from the first voltage terminal Vdd is transferred to the gate of the fourth transistor T4 and the fourth transistor T4 is turned off, thus it prevents the fourth transistor T4 from being turned on in this phase.

Further, the third transistor T3 is in the OFF state because the second scan signal terminal Vscan2 inputs the high voltage level. And, the sixth transistor T6 is in the OFF state since no low voltage level flows into the gate of the sixth transistor T6.

In this phase, the enable signal terminal Em inputs the low voltage level, the seventh transistor T7 is turned on, so that a driving current flowing through the second transistor T2 and the seventh transistor T7 drives the OLED to emit light.

In conclusion, in the display process for the Nth frame, the fifth transistor T5 is in the ON state all the time, the high voltage level input from the first voltage terminal Vdd is transferred to the gate of the fourth transistor T4, so that the fourth transistor T4, which functions as a driving transistor, is in the OFF state. While the second transistor T2, which also functions as the driving transistor, drives the OLED to emit light. Therefore, in the display process for the Nth frame, the threshold voltage of the fourth transistor T4 can be restored.

Figure 5A:
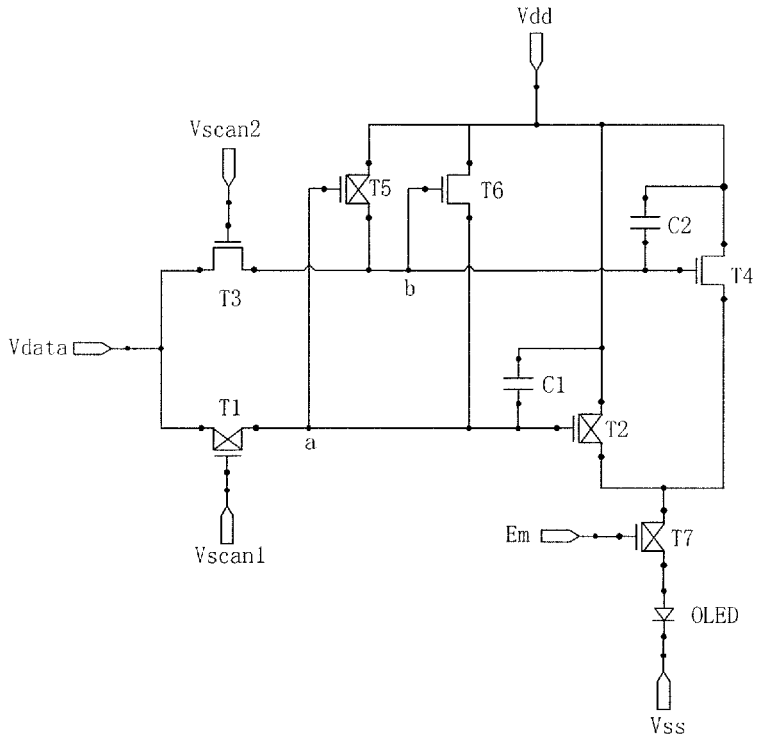
FIG. 5*a* is an exemplary view illustrating ON or OFF state of the pixel circuit shown in FIG. 2, in a writing phase P1' of the (N+1)th frame in FIG. 3.

Next, as illustrated in FIG. 3, in the writing phase P1' for the (N+1)th frame, an equivalent circuit diagram for this phase is illustrated in FIG. 5*a*. In this phase, the second scan signal terminal Vscan2 inputs the low voltage level, the third transistor T3 is turned on, so that the data signal (low voltage level) input from the data signal terminal Vdata is transferred to the gate (at a node b) of the fourth transistor T4 through the third transistor T3 and charges the second capacitor C2.

The sixth transistor T6 is in the ON state because a potential at the node b is the low voltage level, so that the high voltage level input from the first voltage terminal Vdd is transferred to the gate of the second transistor T2 and the second transistor T2 is turned off, thus it prevents the second transistor T2 from being turned on in this phase.

Further, the first transistor T1 and the seventh transistor T7 are both in the OFF state because the first scan signal terminal Vscan1 and the enable signal terminal Em input the high voltage level, so the fifth transistor T5 is in the OFF state in this case.

Therefore, the OLED emits no light in this phase.

Figure 5B:
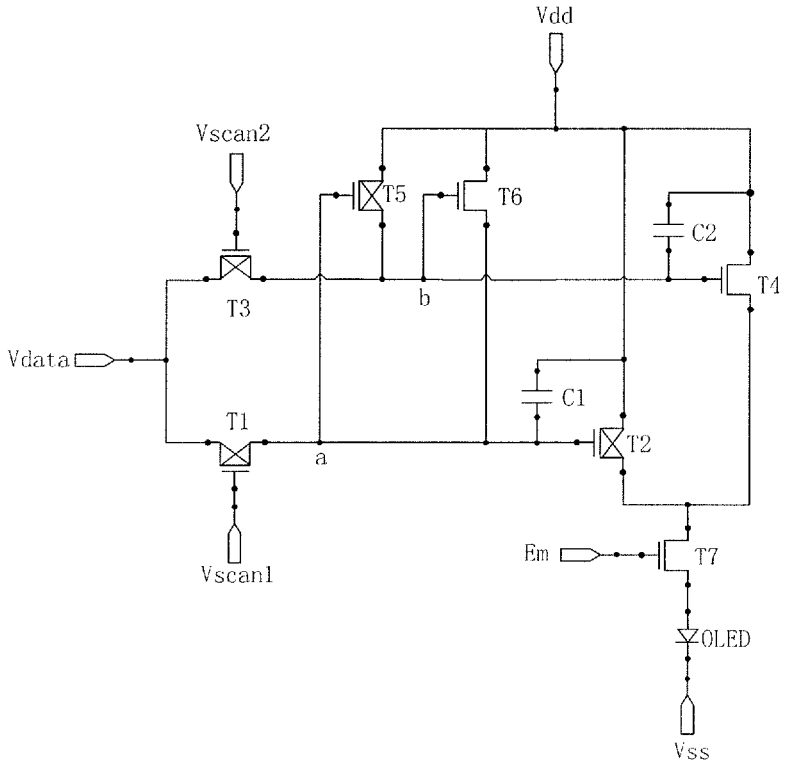
FIG. 5*b* is an exemplary view illustrating ON or OFF state of the pixel circuit shown in FIG. 2, in a light-emitting phase P2' of the Nth frame in FIG. 3.

In the light emitting phase P2' for the (N+1) frame, the equivalent circuit diagram for this phase is illustrated in FIG. 5*b*. The second scan signal terminal Vscan2 inputs the high voltage level, the third transistor T3 is in the OFF state. The second capacitor C2 has a charge retention function, so the node b remains to be in the low voltage level. In this case, the sixth transistor T6 is still turned on, so that the high voltage level input from the first voltage terminal Vdd is transferred to the gate of the second transistor T2 and the second transistor T2 is turned off, thus it prevents the second transistor 12 from being turned on in this phase.

Further, the first transistor T1 is in the OFF state because the first scan signal terminal Vscan1 inputs the high voltage level. And, the fifth transistor T5 is in the OFF state since no low voltage level flows into the gate of the fifth transistor T5.

In this phase, the enable signal terminal Em inputs the low voltage level, the seventh transistor T7 is turned on, so that a driving current flowing through the fourth transistor T4 and the seventh transistor T7 drives the OLED to emit light.

In conclusion, in the display process for the (N+1)th frame, the sixth transistor T6 is in the ON state all the time, the high voltage level input from the first voltage terminal Vdd is transferred to the gate of the second transistor T2, so that the second transistor T2, which functions as the driving transistor, is in the OFF state. While the fourth transistor T4, which also functions as the driving transistor, drives the OLED to emit light. Therefore, in the display process for the (N+1)th frame, the threshold voltage of the second transistor T2 can be restored.

In summary, in the display processes for the Nth and (N+1)th frames, the second transistor T2 and the fourth transistor T4 functioning as the driving transistors drive the OLED to emit light in turn, therefore it can avoid the shifting of the threshold voltage because of a long-time bias voltage state of the gate of the second transistor T2 or the fourth transistor T4, which in turn can improve the uniformity of brightness of the display element.

Embodiment 2

The Embodiment 1 is explained by taking a case where all transistors are P type transistors as an example. In the present embodiment, all transistors may utilize the N type transistors, and in this case, the timing signals shown in FIG. 3 are required to be reversed and the control process is as same as that in FIG. 3, therefore details will not be repeated herein.

The embodiment of present disclosure provides a display apparatus comprising any one of the pixel circuit described above, which can realize the same benefit effects as the pixel circuit according to the embodiment described above. Since the benefit effects of the pixel circuit have been described in the above embodiment in details, the details would not be repeated herein.

For example, the display apparatus according to the embodiment of the present disclosure may be any display apparatus with current-driven light emitting elements, including the LED display or the OLED display.

The embodiment of the present disclosure provides a driving method for driving any one of the pixel circuits described above, as illustrated in FIG. 6, the driving method may comprise steps as follows.

S101, as illustrated in FIG. 3, in a first phase of the Nth frame (namely the writing phase P1), the first switching module 10 is turned on to output the signal of the data signal terminal Vdata to the coupling module 50 and the first driving module 20. In this case, the first driving module 20 is turned on, the signal input from the first voltage terminal Vdd charges the first driving module 20. Further, the coupling module 50 outputs the signal input from the first voltage terminal Vdd to the second driving module 40, the second driving module 40 is turned off.

S102, in a second phase of the Nth frame (namely the light-emitting phase P2), the first driving module 20 remains to be in the ON state, the second driving module 40 remains to be in the OFF state, the light-emitting module 60 is in the ON state, and the first driving module 20 drives the light-emitting module 60 to emit light under the control of the first voltage terminal Vdd.

S103, in a first phase of the (N+1)th frame (namely the writing phase P1'), the second switching module 30 is turned on to output the signal of the data signal terminal Vdata to the coupling module 50 and the second driving module 40. In this case, the second driving module 40 is turned on, the signal input from the first voltage terminal Vdd charges the second driving module 40. Further, the coupling module 50 outputs the signal input from the first voltage terminal Vdd to the first driving module 20, the first driving module 20 is turned off.

S104, in a second phase of the (N+1)th frame (namely the light-emitting phase P2'), the second driving module 40 remains to be in the ON state, the first driving module 20 remains to be in the OFF state, the light-emitting module 60 is in the ON state, and the second driving module 40 drives the light-emitting module 60 to emit light under the control of the first voltage terminal Vdd.

Wherein N is a positive integer greater than or equal to 1.

As such, in the Nth frame, the first driving module is turned on, the coupling module may control the second driving module to be in the OFF state, therefore the first driving module may control the light-emitting module to emit light and the threshold voltages of the TFTs in the second driving module may be restored because the second driving module is in the OFF state. In the (N+1)th frame, the second driving module is turned on, the coupling module may control the first driving module to be in the OFF state, therefore the second driving module may control the light-emitting module to emit light and the threshold voltages of the TFTs in the first driving module may be restored because the first driving module is in the OFF state.

In a word, the driving circuit described above drives the light-emitting module to emit light with the first driving module and the second driving module in turn, therefore it can avoid the shifting of the threshold voltage because of a long-time bias voltage state of the gate of the driving TFT in the driving module, which in turn can improve the uniformity of brightness of the display apparatus.

Figure 6:
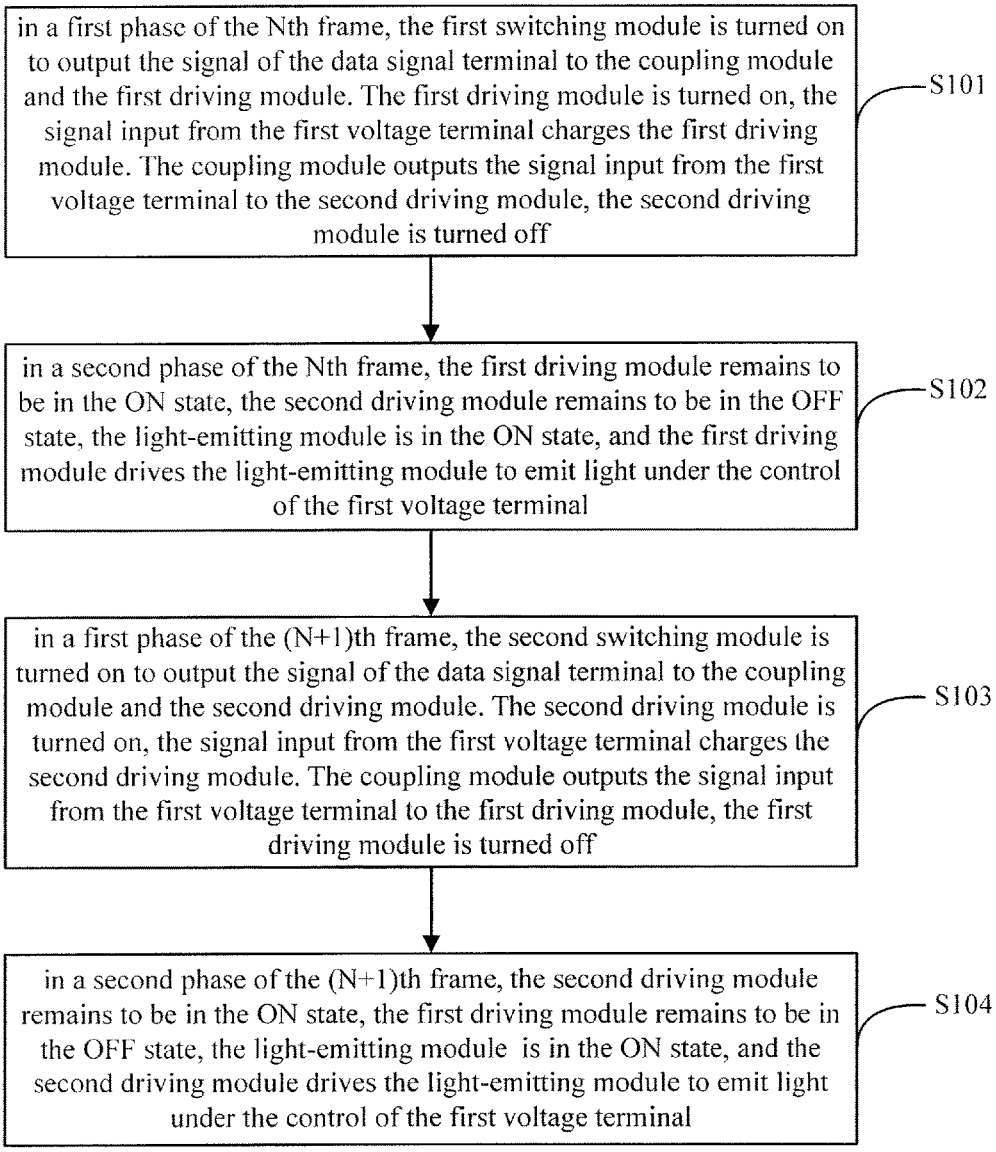
FIG. 6 is a flowchart illustrating a control method of the pixel circuit according to an embodiment of the present disclosure.

In the following, the driving method of the pixel circuit as shown in FIG. 6 will be described in details in connection with FIG. 3 by means of embodiments.

Embodiment 3

In the first phase for the Nth frame (namely the writing phase P1), the first transistor T1 is turned on, the signal input from the data signal terminal Vdata turns on the second transistor T2 and the fifth transistor T5, the signal input from the first voltage terminal Vdd charges the first capacitor C1.

For example, in this phase, the first scan signal terminal Vscan1 inputs the low voltage level and the first transistor T1 is turned on, so that the data signal (low voltage level) input from the data signal terminal Vdata is transferred to the gate (the node a) of the second transistor T2 through the first transistor T1 and charges the first capacitor C1.

Furthermore, the third transistor T3, the sixth transistor T6, the fourth transistor T4 and the seventh transistor T7 are all in the OFF state.

For example, the fifth transistor T5 is in the ON state because the potential at the node a is in the low voltage level, so that the high voltage level input from the first voltage terminal Vdd is transferred to the gate of the fourth transistor T4 and the fourth transistor 14 is turned off, thus it can prevent the fourth transistor T4 from being turned on in this phase.

And, the third transistor T3 and the seventh transistor T7 are both in the OFF state because the second scan signal terminal Vscan2 and the enable signal terminal Em input the high voltage level, so the sixth transistor T6 is in the OFF state in this case.

Therefore the OLED emits no light in this phase.

Next, in the second phase for the Nth frame (namely the light emitting phase P2), the first transistor T1, the third transistor T3 and the sixth transistor T6 are in the OFF state; the fifth transistor T5 and the second transistor 12 remains to be in the ON state under the effect of the first capacitor C1, and the fourth transistor T4 is in the OFF state under the control of the first voltage terminal Vdd; and the current flowing through the second transistor T2 and the seventh transistor T7 drive the light-emitting element to emit light when the seventh transistor T7 is turned on.

For example, the first scan signal terminal Vscan1 inputs the high voltage level, the first transistor T1 is in the OFF state. The first capacitor C1 has a charge retention function, so the node a may remain to be in the low voltage level. In this case, the fifth transistor T5 is still turned on, so that the high voltage level input from the first voltage terminal Vdd is transferred to the gate of the fourth transistor T4 and the fourth transistor T4 is turned off, thus it prevents the fourth transistor T4 from being turned on in this phase.

Further, the third transistor T3 is in the OFF state because the second scan signal terminal Vscan2 inputs the high voltage level. And, the sixth transistor T6 is in the OFF state since no low voltage level flows into the gate of the sixth transistor T6.

In this phase, the enable signal terminal Em inputs the low voltage level, the seventh transistor T7 is turned on, so that the driving current flowing through the second transistor T2 and the seventh transistor T7 drives the OLED to emit light.

In conclusion, in the display process for the Nth frame, the fifth transistor T5 is in the ON state all the time, the high voltage level input from the first voltage terminal Vdd is transferred to the gate of the fourth transistor T4, so that the fourth transistor T4, which functions as the driving transistor, is in the OFF state. While the second transistor T2, which also functions as the driving transistor, drives the OLED to emit light. Therefore, in the display process for the Nth frame, the threshold voltage of the fourth transistor T4 can be restored.

Next, in the first phase for the (N+1)th frame (namely the writing phase P1'), the third transistor T3 is turned on, the signal input from the data signal terminal Vdata turns on the sixth transistor T6 and the fourth transistor T4, the signal input from the first voltage terminal Vdd charges the second capacitor C2, and the first transistor T1, the fifth transistor T5, the second transistor T2 and the seventh transistor T7 are all in the OFF state.

For example, the second scan signal terminal Vscan2 inputs the low voltage level, the third transistor T3 is turned on, so that the data signal (low voltage level) input from the data signal terminal Vdata is transferred to the gate (at the node b) of the fourth transistor T4 through the third transistor T3 and charges the second capacitor C2.

The sixth transistor T6 is in the ON state because the potential at the node b is the low voltage level, so that the high voltage level input from the first voltage terminal Vdd is transferred to the gate of the second transistor T2 and the second transistor T2 is turned off, thus it prevents the second transistor T2 from being turned on in this phase.

Further, the first transistor T1 and the seventh transistor T7 are both in the OFF state because the first scan signal terminal Vscan1 and the enable signal terminal Em input the high voltage level, so the fifth transistor T5 is in the OFF state in this case.

Therefore, the OLED emits no light in this phase.

Next, in the second phase for the (N+1) frame (namely the light emitting phase P2'), the third transistor T3, the first transistor T1 and the fifth transistor T5 are in the OFF state; the sixth transistor T6 and the fourth transistor T4 remains to be in the ON state under the effect of the second capacitor C2, and the second transistor T2 is in the OFF state under the control of the first voltage terminal Vdd; and the current flowing through the fourth transistor T4 and the seventh transistor T7 drive the light-emitting element to emit light when the seventh transistor T7 is turned on.

For example, the second capacitor C2 has the charge retention function, so the node b may remain to be in the low voltage level. In this case, the sixth transistor T6 is still turned on, so that the high voltage level input from the first voltage terminal Vdd is transferred to the gate of the second transistor T2 and the second transistor T2 is turned off, thus it prevents the second transistor 12 from being turned on in this phase.

Further, the first transistor T1 is in the OFF state because the first scan signal terminal Vscan1 inputs the high voltage level. And, the fifth transistor T5 is in the OFF state since no low voltage level flows into the gate of the fifth transistor T5.

In this phase, the enable signal terminal Em inputs the low voltage level, the seventh transistor T7 is turned on, so that a driving current flowing through the fourth transistor T4 and the seventh transistor T7 drives the OLED to emit light.

In conclusion, in the display process for the (N+1)th frame, the sixth transistor T6 is in the ON state all the time, the high voltage level input from the first voltage terminal Vdd is transferred to the gate of the second transistor T2, so that the second transistor T2, which functions as the driving transistor, is in the OFF state. While the fourth transistor T4, which also functions as the driving transistor, drives the OLED to emit light. Therefore, in the display process for the (N+1)th frame, the threshold voltage of the second transistor T2 can be restored.

In summary, in the display processes for the Nth and (N+1)th frames, the second transistor T2 and the fourth transistor T4 functioning as the driving transistors drive the OLED to emit light in turn, therefore it can avoid the shifting of the threshold voltage because of a long-time bias voltage state of the gate of the second transistor T2 or the fourth transistor T4, which in turn can improve the uniformity of brightness of the display element.

Those ordinary skilled in the art can understand that, a part or all of the steps implementing the method embodiments described above can be implemented by a program instructing relevant hardware, the program may be stored in a computer readable storage medium and performs, as executed, the steps for the method embodiments described above. The storage medium may include ROM, RAM, magnetic tape, optical disk or any other medium capable of storing program codes.

The above descriptions only illustrate the specific embodiments of the present invention, and the protection scope of the present invention is not limited to this. Given the teaching as disclosed herein, variations or substitutions, which can easily occur to any skilled pertaining to the art, should be covered by the protection scope of the present invention. Thus, the protection scope of the present invention is defined by the claims The present application claims the priority of Chinese Patent Application No. 201510181402.0 filed on Apr. 16, 2015, entire content of which is incorporated as part of the present invention by reference.

What is claimed is:

1. A pixel circuit comprising a first switching module, a first driving module, a second switching module, a second driving module, a coupling module and a light-emitting module, wherein, the first switching module is connected with a first scan signal terminal, a data signal terminal, the first driving module and the coupling module respectively, and is configured to be turned on or off under the control of the first scan signal terminal, wherein the first switching module outputs a signal of the data signal terminal to the coupling module and the first driving module in the ON state so as to turn on the first driving module;

the second switching module is connected with a second scan signal terminal, the data signal terminal, the second driving module and the coupling module respectively, and is configured to be turned on or off under the control of the second scan signal terminal, wherein the second switching module outputs the signal of the data signal terminal to the coupling module and the second driving module in the ON state so as to turn on the second driving module;

the coupling module is further connected with a first voltage terminal, the first driving module and the second driving module, and is configured to output a signal of the first voltage terminal to the second driving module so as to turn off the second driving module when the first switching module inputs the signal of the data signal terminal; alternatively, is configured to output the signal of the first voltage terminal to the first driving module so as to turn off the first driving module when the second switching module inputs the signal of the data signal terminal;

the first driving module is further connected with the first voltage terminal and the light-emitting module, and is configured to drive the light-emitting module to emit light under the control of the first voltage terminal in the ON state;

the second driving module is further connected with the first voltage terminal and the light-emitting module, and is configured to drive the light-emitting module to emit light under the control of the first voltage terminal in the ON state; and the light-emitting module is further connected with an enable signal terminal and a second voltage terminal, and is configured to emit light as driven by the first driving module or the second driving module under the control of the enable signal terminal and the second voltage terminal, wherein under the control of the first switching module the first driving module remaining to be in the ON state in a Nth frame, under the control of the second switching module the second driving module remaining to be in the OFF state in the Nth frame, under the control of the second switching module the second driving module remaining to be in the IN state in a (N+1)th frame, under the control of the first switching module the first driving module remaining to be in the OFF state in the (N+1)th frame, under the control on enable signal terminal, the light-emitting module being in the OFF state during a writing phase of both the Nth and (N+1)th frames wherein light-emitting module emits no light, and being in the IN state during an emitting phase of both Nth and (N+1)th frames wherein light-emitting module emits light, N is a positive integer greater than or equal to 1.

2. The pixel circuit of claim 1, wherein the first switching module comprises:

a first transistor, a gate thereof is connected with a first scan signal terminal, a first electrode thereof is connected with a data signal terminal and a second electrode is connected with the first driving module.

3. The pixel circuit of claim 2, wherein the first driving module comprises a second transistor and a first capacitor;

a gate of the second transistor is connected with the first switching module, a first electrode thereof is connected with a first voltage terminal, a second electrode is connected with the light-emitting module;

one terminal of the first capacitor is connected with the gate of the second transistor, and the other terminal is connected with the first electrode of the second transistor.

4. The pixel circuit of claim 3, wherein the second switching module comprises:

a third transistor, a gate thereof is connected with a second scan signal terminal, a first electrode thereof is connected with the data signal terminal and a second electrode thereof is connected with the second driving module.

5. The pixel circuit of claim 4, wherein the second driving module comprises a fourth transistor and a second capacitor;

a gate of the fourth transistor is connected with the second switching module, a first electrode thereof is connected with the first voltage terminal and a second electrode thereof is connected with the light-emitting module;

one terminal of the second capacitor is connected with the gate of the fourth transistor, and the other terminal is connected with the first electrode of the fourth transistor.

6. The pixel circuit of claim 5, wherein the coupling module comprises a fifth transistor and a sixth transistor;

a gate of the fifth transistor is connected with the first switching module, a first electrode thereof is connected with the first voltage terminal and a second electrode thereof is connected with the second driving module;

a gate of the sixth transistor is connected with the second switching module, a first electrode thereof is connected with the first voltage terminal, a second electrode thereof is connected with the first driving module.

7. The pixel circuit of claim 6, wherein the light-emitting module comprises a seventh transistor and a light-emitting element;

a gate of the seventh transistor is connected with the enable signal terminal, a first electrode thereof is connected with the first driving module and the second driving module, and a second electrode thereof is connected with an anode of the light-emitting element;

a cathode of the light-emitting element is connected with a second voltage terminal.

8. A display apparatus comprising the pixel circuit of claim 1.

9. A driving method of a pixel circuit, for driving the pixel circuit of claim 1, wherein the method comprises:

in a writing phase of a Nth frame, the first switching module being turned on to output the signal of the data signal terminal to the coupling module and the first driving module; the first driving module being turned on, the signal input from the first voltage terminal charging the first driving module; the light-emitting module being in the OFF state under the control of enable signal terminal, and the coupling module outputting the signal input from the first voltage terminal to the second driving module, the second driving module being turned off;

in a emitting phase of the Nth frame, the first driving module remaining to be in the ON state, the second driving module remaining to be in the OFF state, the light-emitting module being in the ON state under the control of enable signal terminal, and the first driving module driving the light-emitting module to emit light under the control of the first voltage terminal;

in a writing phase of a (N+1)th frame, the second switching module being turned on to output the signal of the data signal terminal to the coupling module and the second driving module; the second driving module being turned on, the signal input from the first voltage terminal charging the second driving module; the light-emitting module being in the OFF state under the control of enable signal terminal, and the coupling module outputting the signal input from the first voltage terminal to the first driving module, the first driving module being turned off;

in a emitting phase of the (N+1)th frame, the second driving module remaining to be in the ON state, the first driving module remaining to be in the OFF state, the light-emitting module being in the ON state under the control of enable signal terminal, and the second driving module driving the light-emitting module to emit light under the control of the first voltage terminal;

wherein N is a positive integer greater than or equal to 1.

10. A driving method of a pixel circuit for driving the pixel circuit of claim 7, wherein the method comprises:

in a writing phase for a Nth frame, the first transistor being turned on, the signal input from the data signal terminal turning on the second transistor and the fifth transistor, the signal input from the first voltage terminal charging the first capacitor, the third transistor, the sixth transistor, the fourth transistor and the seventh transistor being in the OFF state;

in a emitting phase for the Nth frame, the first transistor, the third transistor and the sixth transistor being in the OFF state; the fifth transistor and the second transistor remaining to be in the ON state under the effect of the first capacitor, and the fourth transistor being in the OFF state under the control of the first voltage terminal; and the current flowing through the second transistor and the seventh transistor driving the light-emitting element to emit light when the seventh transistor is turned on;

in a writing phase for a (N+1)th frame, the third transistor being turned on, the signal input from the data signal terminal turning on the sixth transistor and the fourth transistor, the signal input from the first voltage terminal charging the second capacitor, and the first transistor, the fifth transistor, the second transistor and the seventh transistor being in the OFF state; and in a emitting phase for the (N+1) frame, the third transistor, the first transistor and the fifth transistor being in the OFF state; the sixth transistor and the fourth transistor remaining to be in the ON state under the effect of the second capacitor, and the second transistor being in the OFF state under the control of the first voltage terminal; and the current flowing through the fourth transistor and the seventh transistor driving the light-emitting element to emit light when the seventh transistor is turned on.

11. The pixel circuit of claim 1, wherein the first driving module comprises a second transistor and a first capacitor;

a gate of the second transistor is connected with the first switching module, a first electrode thereof is connected with a first voltage terminal, a second electrode is connected with the light-emitting module;

one terminal of the first capacitor is connected with the gate of the second transistor, and the other terminal is connected with the first electrode of the second transistor.

12. The pixel circuit of claim 1, wherein the second switching module comprises:

a third transistor, a gate thereof is connected with a second scan signal terminal, a first electrode thereof is connected with the data signal terminal and a second electrode thereof is connected with the second driving module.

13. The pixel circuit of claim 2, wherein the second switching module comprises:

a third transistor, a gate thereof is connected with a second scan signal terminal, a first electrode thereof is connected with the data signal terminal and a second electrode thereof is connected with the second driving module.

14. The pixel circuit of claim 1, wherein the second driving module comprises a fourth transistor and a second capacitor;

a gate of the fourth transistor is connected with the second switching module, a first electrode thereof is connected with the first voltage terminal and a second electrode thereof is connected with the light-emitting module;

one terminal of the second capacitor is connected with the gate of the fourth transistor, and the other terminal is connected with the first electrode of the fourth transistor.

15. The pixel circuit of claim 2, wherein the second driving module comprises a fourth transistor and a second capacitor;

a gate of the fourth transistor is connected with the second switching module, a first electrode thereof is connected with the first voltage terminal and a second electrode thereof is connected with the light-emitting module;

one terminal of the second capacitor is connected with the gate of the fourth transistor, and the other terminal is connected with the first electrode of the fourth transistor.

16. The pixel circuit of claim 3, wherein the second driving module comprises a fourth transistor and a second capacitor;

a gate of the fourth transistor is connected with the second switching module, a first electrode thereof is connected with the first voltage terminal and a second electrode thereof is connected with the light-emitting module;

one terminal of the second capacitor is connected with the gate of the fourth transistor, and the other terminal is connected with the first electrode of the fourth transistor.

17. The pixel circuit of claim 1, wherein the coupling module comprises a fifth transistor and a sixth transistor;

a gate of the fifth transistor is connected with the first switching module, a first electrode thereof is connected with the first voltage terminal and a second electrode thereof is connected with the second driving module;

a gate of the sixth transistor is connected with the second switching module, a first electrode thereof is connected with the first voltage terminal, a second electrode thereof is connected with the first driving module.

18. The pixel circuit of claim 2, wherein the coupling module comprises a fifth transistor and a sixth transistor;

a gate of the fifth transistor is connected with the first switching module, a first electrode thereof is connected with the first voltage terminal and a second electrode thereof is connected with the second driving module;

a gate of the sixth transistor is connected with the second switching module, a first electrode thereof is connected with the first voltage terminal, a second electrode thereof is connected with the first driving module.

19. The pixel circuit of claim 1, wherein the light-emitting module comprises a seventh transistor and a light-emitting element;

a gate of the seventh transistor is connected with the enable signal terminal, a first electrode thereof is connected with the first driving module and the second driving module, and a second electrode thereof is connected with an anode of the light-emitting element;

a cathode of the light-emitting element is connected with a second voltage terminal.

20. A display apparatus comprising the pixel circuit of claim 2.

* * * * *